United States Patent [19]

Wenger

[11] 3,994,125

[45] Nov. 30, 1976

[54] WINDING TIME-SETTING PUSH-BUTTON ASSEMBLY FOR A WATCH

[75] Inventor: Karl Wenger, Chambesy, Switzerland

[73] Assignee: Boninchi S.A., Switzerland

[22] Filed: June 20, 1975

[21] Appl. No.: 588,710

[30] Foreign Application Priority Data

July 2, 1974 Switzerland ..... 9038/74

[52] U.S. Cl. ..... 58/90 B; 58/63; 58/73

[51] Int. Cl.[2] ..... G04B 37/08; G04B 27/02

[58] Field of Search ..... 58/50 R, 63, 73, 85.5, 58/90 B

[56] References Cited

UNITED STATES PATENTS

| | | | |
|---|---|---|---|
| 2,974,474 | 3/1961 | Wegner | 58/50 R |
| 3,452,819 | 7/1969 | Simon | 58/90 B |
| 3,783,607 | 1/1974 | Fowrer | 58/50 R |

*Primary Examiner*—E. S. Jackmon
*Attorney, Agent, or Firm*—Robert E. Burns; Emmanuel J. Lobato; Bruce L. Adams

[57] ABSTRACT

A watch winding and time setting assembly comprises a crown body having an axial passage extending therethrough, and a push-button located in said axial passage. Said passage comprises a first portion of circular cross-section in which is located a cylindrical head of the pushbutton, a second portion of non-circular cross-section greater than the diameter of the first portion and in which a shoulder of the pushbutton is keyed, and a third cylindrical portion having a diameter no smaller than the second portion, which third passage portion has a sleeve fixed therein for receiving and retaining a compression spring. Said spring biases said shoulder into abutment with the lower edge of the first passage portion, and the sleeve acts as a limit stop for said shoulder portion.

2 Claims, 2 Drawing Figures

FIG. 1
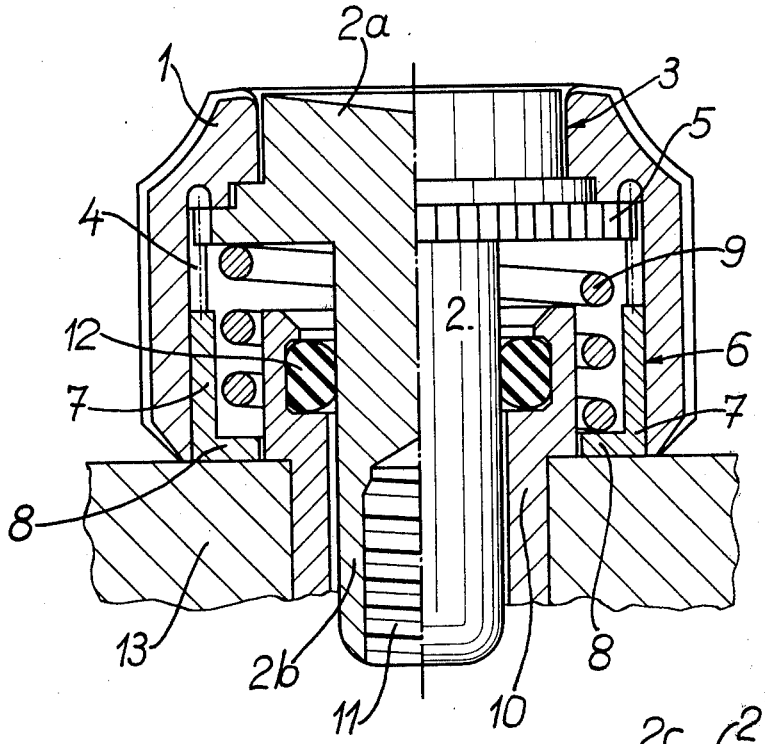
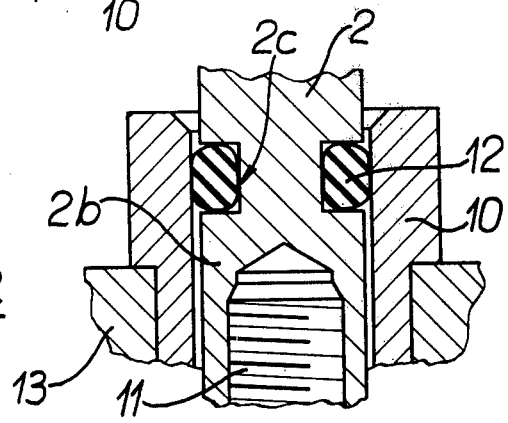
FIG. 2

WINDING TIME-SETTING PUSH-BUTTON ASSEMBLY FOR A WATCH

The invention relates to a winding and time-setting push-button assembly for a watch, the assembly having a central push-button which is capable of actuating an additional mechanism, such as, for example, rapidly setting the date of a calender provided on a watch.

Various assemblies of this type are known, one of which comprises a crown body having an axial passage formed therein. A first portion of this passage has a cross-section which is non-circular and a second portion which is circular in cross-section and is coaxial with the first portion, but has a diameter greater than the corresponding dimension of the first portion. The assembly also includes a push-button having a non-circular head having the same general shape as that of the first portion of the passage and a cylindrical portion. A spring is located in the second portion of the axial passage which acts on the push-button in the direction towards the head of the assembly. This causes the cylinder to press against a shoulder of the body located between the two portions of the passage. A retaining ring is also provided upon which the spring bears with a permanent initial tension. The non-circular head of the push-button is located in the first portion of the passage in the body portion. The entire assembly is so arranged that the push-button cooperates with the body portion in rotary movement but acts independently thereof when the push-button is axially displaced in the passage. The bearing of the cylinder against the shoulder prevents the push-button from projecting from the upper surface of the body portion.

Such an arrangement has two disadvantages which it is the object of the present invention to surmount. The first of these disadvantages is that the crown body is guided on the push-button by a cylindrical portion which is very shallow in depth. This guiding is consequently not particularly efficient. Secondly, the first portion of the push-button is non-circular in shape. This portion therefore has to be made by milling and the corresponding part of the crown by stamping. These are two relatively difficult operations.

According to the present invention there is provided a winding and time setting assembly for a watch, the assembly being provided with a central push-button capable of actuating an additional mechanism such as for rapidly setting the date of a calender, comprising a body having an axial passage formed therein, the passage having a first portion of circular cross-section, a second portion of non-circular cross-section, the diameter of the first portion being less than the corresponding dimensions of the second portion, and a third portion of circular cross-section having a diameter equal to or greater than the corresponding dimension of the second portion. Said first portion forms a recess for receiving a cylindrical head of the push-button, the push-button having a shoulder which is axially displaceable within the second portion, the shoulder having a cross-section corresponding substantially with that of the second portion such that the body and the push-button are rotationally engageable with one another. The third cylindrical portion forms a recess for receiving and retaining a sleeve for a compression spring, which in a first position of the push-button retains the shoulder in abutment with the bottom of the first portion of the body, the sleeve acting as a limit stop for the push-button, when said push-button is axially displaced by abutment of the shoulder against the upper edge of the sleeve.

The invention will be further described, by way of example, with reference to the accompanying drawings, in which:

FIG. 1 is an axial section through a winding button assembly in accordance with the invention; and FIG. 2 is an axial cross-sectional view of a part of a variation of the assembly shown in FIG. 1.

The assembly shown in FIG. 1 comprises a crown body 1 for winding and setting the time of a watch, a portion of the watch case being shown at 13. The body 1 has a central push-button 2 which can be axially displaced to actuate a mechanism for rapidly setting the date on, for example, a calender watch. This mechanism is known and therefore will not be described.

The body 1 has an axial passage formed therein, a first portion 3 thereof being of circular cross-section and which acts as a recess for receiving the cylindrical head 2*a* of push-button 2. The second portion 4 of the passage is of non-circular cross-section such as, for example, fluted. The diameter of the first portion 3 is less than the corresponding outer dimension of the second portion 4. This latter receives a shoulder 5 of push-button 2. The shoulder 5 has a cross-section corresponding to that of second portion 4, so that it may be axially displaced thereon whilst still ensuring that the push-button 2 is fixed for rotation together with crown body 1.

Finally, the passage comprises a third portion 6 which is substantially cylindrical in shape and has a diameter equal to or greater than the circumscribed diameter of second portion 4. The cylindrical portion 6 forms a recess in which a sleeve 7 is secured by force-fitting and/or cementing. This attachment may also be achieved by setting the edge of body 1.

Sleeve 7 has a flange 8 for retaining a compression spring 9 in position. The upper end (as shown) of the sleeve 7 acts as a limiting stop for the axial movement of the shoulder 5 when the push-button 2 is depressed. When the push-button 2 is in its rest position, the shoulder 5 is in abutment with the lower edge of the first portion 3.

The push-button 2 has a cylindrical stem 2*b*, by means of which the push-button assembly is guided in a pendant tube 10 which is connected to the watch case 13.

Stem 2*b* has a threaded bore 11 for securing a winding stem, not shown.

A seal between the push-button 2 and the tube 10 is achieved by means of packing 12. This packing 12 is inserted into a groove or recess formed in the tube 10 and exerts a sealing pressure between the recess and the stem 2*b* of push-button 2.

The operation of the push-button assembly will now be described.

In its normal or winding position, the winding button assembly is in the position shown in FIG. 1, with body 1 held by the winding stem (not shown). It will be noted that in this position, the base of the assembly is flush with, or very close to, case 13. In this position, it is possible to actuate a date setting mechanism by applying pressure to the push-button 2. Due to this pressure, the push-button 2 is axially displaced and the winding stem (not shown) actuates a lever for changing the date, as is well known in the art.

By pulling the winding button assembly away from case 13, the sleeve 7 engages with the lower end of the spring 9 and tends to compress this latter. Under the biassing action of spring 9, push-button 2 is pulled outwardly with the body portion 1. In this position, the winding stem is in engagement with the hand-setting mechanism of the watch. Since the body 1 is rotatably engaged with the push-button 2 and thus with the winding stem, rotation of the assembly rotates the hands of the watch. By pushing the body 1 back towards the casing 13, the assembly reassumes the initial position shown in the drawings.

In the arrangement shown in FIG. 1, the body 1 is guided and centred in two ways, firstly by the pendant tube 10 and the sleeve 7, and secondly by the head of the cylindrical push-button 2. The push-button 2 can be produced by turning a fluted rod and is therefore simple to manufacture. The body 1 is also produced by turning, the fluting being obtained by punching out or striking during the turning operation. The seal achieved between push-button 2 and pendant tube 10 enables the assembly of the present invention to be used in a sealed watch.

The non-circular portion 4 need not necessarily be fluted. Other suitable shapes will be readily apparent to those skilled in the art.

In the embodiment shown in FIG. 2, the seal between the push-button 2 and the tube 10 is achieved by packing 12 inserted in a groove 2*c* formed in the cylindrical stem 2*b* of the push-button 2 rather than in a recess provided in the body 1. The packing 12 exerts a sealing pressure between the inner wall of the tube 10 and the wall of the recess 2*c*.

What is claimed is:

1. In a watch, a winding and time setting assembly including a push-button capable of actuating an additional mechanism such as for rapidly setting the date of a calender mechanism, the assembly comprising a crown body having surfaces defining an axial passage extending therethrough, said body having a first body portion defining a first cylindrical passage portion, a second body portion defining a non-circular second passage portion circumscribed within a cylinder having a diameter greater than that of said first passage portion, and a third body portion defining a third cylindrical passage portion having a diameter at least equal to the diameter of said cylinder circumscribing the second passage portion, a push-button having a cylindrical head located within said first passage portion of the body member, and a shoulder which is axially but non-rotatably displaceable within said second passage portion, said shoulder having a cross-section corresponding substantially with that of the second passage portion such that the body and the push-button are rotationally engageable with each other; a sleeve received and retained in the third cylindrical passage portion; and a compression spring disposed in said sleeve, said spring retaining the shoulder of the push-button in abutment with said first body portion of the body member in a first position of the push-button, said sleeve acting as a limit stop for the push-button when said push-button is axially displaced to cause the shoulder portion thereof to abut against the sleeve.

2. An assembly according to claim 1, comprising a pendant tube, said push-button having a shank slidably and rotatably mounted in said pendant tube, a packing providing fluid-tightness between said shank and said pendant tube, and means defining a recess in one of said shank and said pendant tube to house said packing.

* * * * *